US010518549B2

(12) United States Patent
Yoshida

(10) Patent No.: US 10,518,549 B2
(45) Date of Patent: Dec. 31, 2019

(54) LIQUID EJECTING APPARATUS AND METHOD OF DISCHARGING LIQUID USING THE SAME

(71) Applicant: SEIKO EPSON CORPORATION, Tokyo (JP)

(72) Inventor: Takeshi Yoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/129,672

(22) Filed: Sep. 12, 2018

(65) Prior Publication Data

US 2019/0077164 A1 Mar. 14, 2019

(30) Foreign Application Priority Data

Sep. 14, 2017 (JP) ..... 2017-176531

(51) Int. Cl.
*B41J 2/175* (2006.01)
*B41J 2/165* (2006.01)
(Continued)

(52) U.S. Cl.
CPC ..... *B41J 2/17596* (2013.01); *B41J 2/04586* (2013.01); *B41J 2/16505* (2013.01); *B41J 2/16523* (2013.01); *B41J 2002/14403* (2013.01); *B41J 2002/16594* (2013.01); *B41J 2202/05* (2013.01)

(58) Field of Classification Search
CPC ..... B41J 2/17596; B41J 2/16508; B41J 2/16532; B41J 2/16526; B41J 2/175; B41J 2/16523; B41J 2/16505; B41J 2/04586; B41J 2002/16594; B41J 2202/05; B41J 2002/14403
See application file for complete search history.

(56) References Cited

U.S. PATENT DOCUMENTS

2004/0119796 A1 6/2004 Kumagai
2010/0026739 A1 2/2010 Hirashima
(Continued)

FOREIGN PATENT DOCUMENTS

JP 2004-090432 A 3/2004
JP 2004-098475 A 4/2004
(Continued)

OTHER PUBLICATIONS

IP.com search (Year: 2019).*

*Primary Examiner* — Lisa Solomon
(74) *Attorney, Agent, or Firm* — Workman Nydegger

(57) ABSTRACT

A liquid ejecting apparatus includes a liquid ejecting unit and a pump. The liquid ejecting apparatus has a supply channel, a return channel, and a communication channel. The supply channel is designed to be able to supply the liquid from a liquid supply source to the nozzle. The return channel has ends connected to the supply channel and forms, together with the supply channel, a circulation channel. The communication channel is connected to the return channel and allows communication between an inside of the return channel and an outside. In a state in which the return channel communicates with the outside through the communication channel, the pump is driven so as to perform a return-channel replacement operation in which the liquid in the return channel is discharged to the supply channel side.

9 Claims, 10 Drawing Sheets

(51) Int. Cl.
*B41J 2/045* (2006.01)
*B41J 2/14* (2006.01)

(56) References Cited

U.S. PATENT DOCUMENTS

| | | | | |
|---|---|---|---|---|
| 2010/0328408 | A1* | 12/2010 | Akiyama | B41J 2/175 347/92 |
| 2012/0212550 | A1 | 8/2012 | Hori et al. | |
| 2013/0100205 | A1 | 4/2013 | Sunouchi et al. | |
| 2018/0093491 | A1 | 4/2018 | Murayama et al. | |

FOREIGN PATENT DOCUMENTS

| | | | |
|---|---|---|---|
| JP | 2010-030206 | A | 2/2010 |
| JP | 2010-269606 | A | 12/2010 |
| JP | 2011-073218 | A | 4/2011 |
| JP | 2012-171181 | A | 9/2012 |
| JP | 2013-086439 | A | 5/2013 |
| JP | 2013-237209 | A | 11/2013 |
| JP | 2016-068314 | A | 5/2016 |
| JP | 2018-058255 | A | 4/2018 |

* cited by examiner

LIQUID EJECTING APPARATUS AND METHOD OF DISCHARGING LIQUID USING THE SAME

BACKGROUND

1. Technical Field

The present invention relates to a liquid ejecting apparatus such as a printer and a method of discharging liquid using the liquid ejecting apparatus.

2. Related Art

Examples of liquid ejecting apparatuses include ink jet printers that eject ink (liquid) supplied from an ink cartridge (liquid supply source) through a liquid ejecting head (liquid ejecting unit) toward a sheet of paper for printing. Some of such printers use pigment ink, in which a pigment is dispersed in a solvent, for printing (for example, JP-A-2013-237209).

The pigment of pigment ink may sediment in the solvent over time, resulting in uneven density of the ink. Accordingly, in each of the printers, a circulation channel through which the ink circulates is provided in a liquid channel (supply channel) through which the ink is supplied from the ink cartridge to the liquid ejecting head, and the printer allows cleaning to be performed with a cleaning liquid. That is, the printer causes the ink to flow so as to agitate the ink in the circulation channel, and a remaining sunk substance that has not been dispersed even by the agitation is washed off with the cleaning liquid.

The cleaning with the cleaning liquid is performed by discharging the ink from the liquid channel and the circulation channel. However, when the ink is sucked so as to be discharged from the liquid ejecting head, the ink remains in the circulation channel. Thus, the ink is not easily discharged.

Such a problem is not limited to the printer including the circulation channel. The problem is substantially common to liquid ejecting apparatuses including the circulation channel and methods of discharging liquid using the liquid ejecting apparatus.

SUMMARY

An advantage of some aspects of the invention is to provide a liquid ejecting apparatus that can efficiently discharge liquid in a circulation channel and a method of discharging liquid using the liquid ejecting apparatus.

An apparatus and a method that address the above-described problem are described below.

A liquid ejecting apparatus that addresses the above described problem includes a liquid ejecting unit, a pump, and a controller. The liquid ejecting unit ejects liquid from a nozzle. The liquid ejecting apparatus has a supply channel, a return channel, and a communication channel. The supply channel is designed to supply the liquid from a liquid supply source to the nozzle. The return channel has ends connected to the supply channel and forms, together with the supply channel, a circulation channel. The communication channel is connected to the return channel and allows communication between an inside of the return channel and an outside. The pump is designed to cause fluid in the circulation channel to flow. In a state in which the return channel communicates with the outside through the communication channel, the controller drives the pump to perform a return-channel replacement operation in which the liquid in the return channel is discharged to the supply channel side.

A method of discharging liquid in a liquid ejecting apparatus is a method that addresses the above described problem. The liquid ejecting apparatus includes a liquid ejecting unit that ejects liquid from a nozzle. The liquid ejecting apparatus has a supply channel, a return channel, and a communication channel. The supply channel is designed to be able to supply the liquid from a liquid supply source to the nozzle. The return channel has ends connected to the supply channel and forms, together with the supply channel, a circulation channel. The communication channel is connected to the return channel and allows communication between an inside of the return channel and an outside. The method includes performing, in a state in which the return channel communicates with the outside through the communication channel, a return-channel replacement operation in which the liquid in the return channel is discharged to the supply channel side.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a liquid ejecting apparatus and a method of discharging liquid using the liquid ejecting apparatus will be described below with reference to the drawings. The liquid ejecting apparatus is, for example, an ink jet printer that performs recording (printing) on a medium such as a sheet of paper by ejecting ink serving as an example of the liquid.

Figure 1:
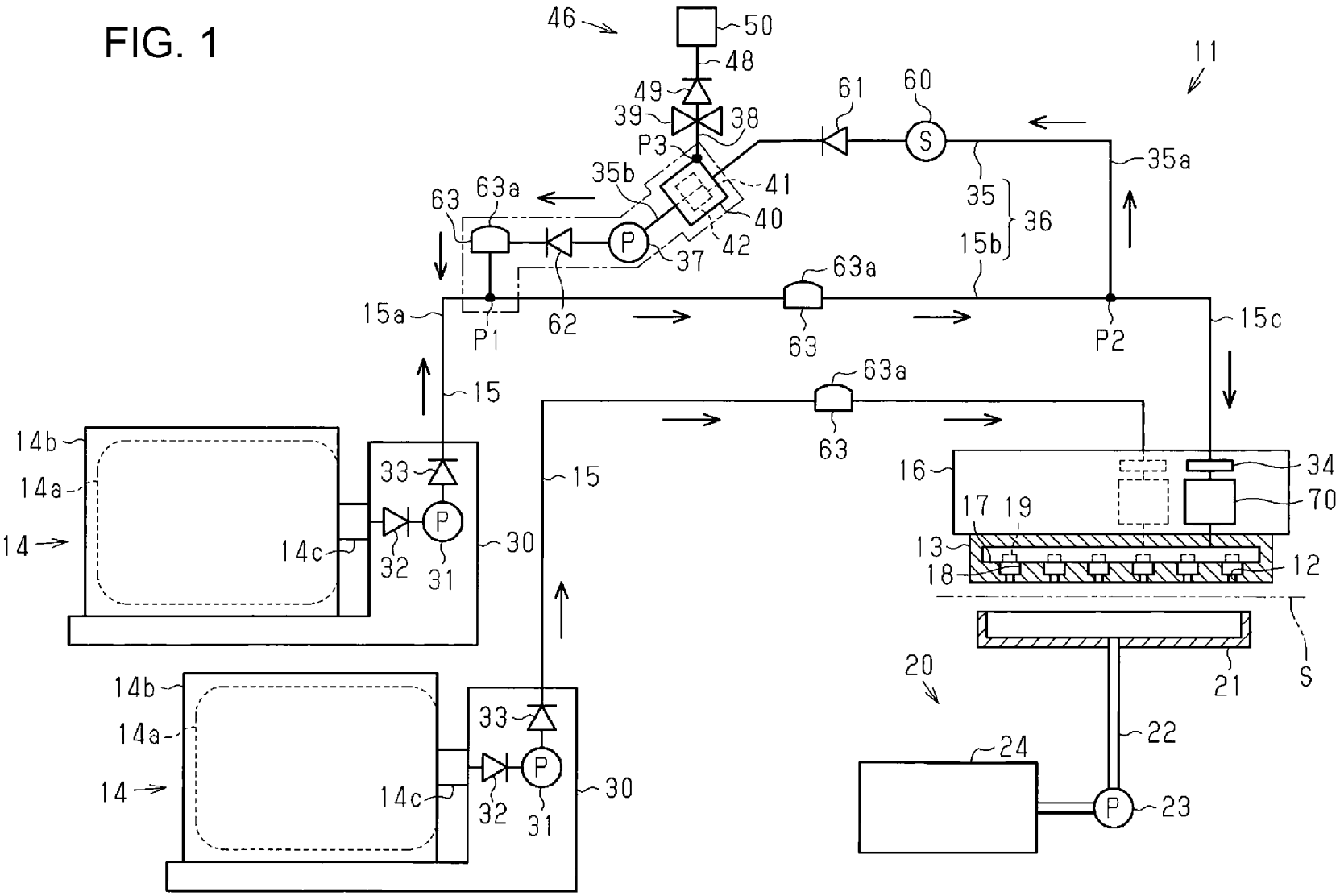
FIG. 1 is an overall structural view of an embodiment of a liquid ejecting apparatus.

As illustrated in FIG. 1, a liquid ejecting apparatus 11 includes a liquid ejecting unit 13, supply channels 15, and a maintenance device 20. The liquid ejecting unit 13 ejects liquid from nozzles 12 toward a medium S. The supply channels 15 can supply the liquid from liquid supply sources 14 to the nozzles 12. The maintenance device 20 performs maintenance on the liquid ejecting unit 13. The liquid ejecting apparatus 11 according to the present embodiment includes, as the liquid supply sources 14, a plurality of liquid containers that contain different types of liquid. The nozzles 12 and the supply channels 15 are provided in accordance with the types of liquid. Furthermore, a plurality of the nozzles 12 are provided for each of the types of liquid.

The left-right direction of the page of FIG. 1 corresponds to the vertical direction (direction of gravity), and the right side of the page corresponds to the lower side in the vertical direction.

The liquid contained in at least one of the liquid supply sources 14 is an ink in which a pigment exhibiting sedimentation properties is mixed with water as a solution (for example, a white ink containing a white pigment). The liquid contained in another liquid supply source 14 does not contain a pigment or an ink containing a small amount of a pigment (for example, an ink of a color such as cyan, magenta, or yellow).

The liquid supply sources 14 each include, for example, a bag 14*a*, a containing case 14*b*, and an outlet 14*c*. The bag 14*a* contains the liquid. The containing case 14*b* contains the bag 14*a*. The liquid contained in the bag 14*a* flows out to the outside of the containing case 14*b* through the outlet 14*c*. In this case, the liquid ejecting apparatus 11 includes mounting portions 30 on which the liquid supply sources 14 are removably mounted.

Each of the mounting portions 30 includes a supply pump 31 that pressurizes the liquid in the liquid supply source 14 to supply the liquid toward the liquid ejecting unit 13. The supply pump 31 is, for example, a diaphragm pump. One-way valves 32, 33 are respectively provided upstream of and downstream of the supply pump 31. The supply pump 31 may be, for example, a tube pump or a blower pump. The blower pump supplies the liquid by sending a pressurized gas into the containing case 14*b* so as to squeeze the bag 14*a*. When the supply pump 31 is a tube pump or a blower pump, the one-way valves 32, 33 are not necessarily provided.

When liquid accumulating portions 63 in which the liquid is temporarily stored are provided partway along the supply channels 15, the pressure of the liquid supplied to the liquid ejecting unit 13 is stabilized. The liquid accumulating portions 63 may be open tanks the insides of which are exposed to the atmosphere. Alternatively, when using a closed liquid accumulating chamber the wall of which is partially formed by a film 63*a* that can be bent, mixing of gas into the liquid can be suppressed.

The liquid ejecting unit 13 has a common liquid chamber 17 and a plurality of cavities 18. The common liquid chamber 17 temporarily stores the liquid supplied from the liquid supply sources 14. The cavities 18 respectively correspond to the plurality of nozzles 12. The common liquid chamber 17 and the cavities 18 are parts of the supply channels 15 through which the liquid is supplied to the nozzles 12. The liquid ejecting unit 13 includes a plurality of actuators 19 that respectively correspond to the cavities 18. The liquid is ejected from the nozzles 12 by driving the actuators 19.

When pressure adjustment mechanisms 70 that adjust the pressure of the liquid to be pressurized and supplied are provided upstream of the common liquid chamber 17, the pressure of the liquid to be supplied to the nozzles 12 is stabilized. It is preferable that filters 34 that filter the liquid be provided upstream of the common liquid chamber 17. The filters 34 have a trapping ability with which foreign matter that cannot pass through the liquid ejecting unit 13 can be trapped.

When the liquid ejecting apparatus 11 includes a holder 16 that holds the liquid ejecting unit 13, the holder 16 may hold the pressure adjustment mechanisms 70 and the filters 34. The holder 16 may be a carriage that holds the liquid ejecting unit 13 of a serial type and transversely reciprocates the medium S or a structure with which the liquid ejecting unit 13 of a line head type is fixed onto a transport path of the medium S.

In order to prevent or eliminate ejection failure caused by, for example, clogging of the nozzles 12, entering of bubbles in the liquid ejecting unit 13, or adhering of foreign matter to regions around the nozzles 12, maintenance operations such as flushing, capping, and suction cleaning are performed in the liquid ejecting apparatus 11. The flushing refers to discharging of the liquid from the nozzles 12 to discharge foreign matter, bubbles, or altered liquid (for example, thickened ink) that may cause ejection failure. The flushing is performed to eliminate minor ejection failure.

The maintenance device 20 includes a cap 21, a suction tube 22, a suction pump 23, and a waste liquid container 24. An upstream end of the suction tube 22 is connected to the cap 21. The suction pump 23 is provided partway along the suction tube 22. A downstream end of the suction tube 22 is connected to the waste liquid container 24. The suction pump 23 may be, for example, a tube pump or a pump of another type.

At least one of the cap 21 and the liquid ejecting unit 13 is relatively movable between a capping position where a space at which the nozzles 12 are open is closed and a retracted position where the space at which the nozzles 12 are open is open. When the cap 21 is disposed at the capping position, capping is performed. When liquid ejection is not performed, the maintenance device 20 performs the capping so as to suppress drying of the nozzles 12. This prevents ejection failure.

The suction pump 23 applies a negative pressure to the liquid ejecting unit 13 so as to discharge fluid in the liquid ejecting unit 13 to the outside. Specifically, when a negative pressure generated by driving the suction pump 23 acts on a closed space formed by disposing the cap 21 at the capping position, the fluid is sucked and discharged from the nozzles 12 due to the negative pressure. This operation is referred to as the suction cleaning. The liquid discharged from the nozzles 12 due to the suction cleaning is contained in the waste liquid container 24 as waste liquid. When performing the suction cleaning, the liquid in the liquid supply sources 14 may be pressurized to be supplied by driving the supply pumps 31. Due to the suction cleaning, the liquid containing foreign matter such as bubbles is discharged from the nozzles 12, and at the same time, the supply channels 15 are filled with new liquid supplied from the liquid supply sources 14.

At least one of the supply channels 15 where liquid containing a component exhibiting sedimentation properties, for example, a white ink flows is provided with a return channel 35. Both ends of the return channel 35 are connected to the supply channel 15. The return channel 35 is connected to a first position P1 of the supply channel 15 at a first end and to a second position P2 closer to the nozzles 12 than the first position P1 in the supply channel 15 at a second end on the opposite side to the first end. That is, the second end is connected to the second position P2 closer to the nozzles 12 than the first position P1.

The supply channel 15 has an upstream channel 15*a*, an intermediate channel 15*b*, and a downstream channel 15*c*. The upstream channel 15*a* is from the corresponding liquid supply source 14 to the first position P1. The intermediate channel 15*b* is from the first position P1 to the second position P2. The downstream channel 15*c* includes a liquid channel from the second position P2 to the liquid ejecting unit 13 and a liquid channel to the nozzles 12 of the liquid ejecting unit 13.

The supply channel 15 and the return channel 35 form a circulation channel 36. It is preferable that one of the liquid accumulating portions 63 be provided in the intermediate channel 15*b* in the supply channel 15 to which the return channel 35 is connected. The intermediate channel 15*b* is positioned between the first position P1 and the second position P2 and included in the circulation channel 36. The direction in which the fluid flows through the supply channel 15 and the return channel 35 is indicated by arrows in FIG. 1. The supply pump 31 is disposed in the upstream channel 15*a* closer to the liquid supply source 14 than the first position P1 in the supply channel 15 and supplies the liquid from the liquid supply source 14 toward the liquid ejecting unit 13.

The liquid ejecting apparatus 11 includes a circulation pump 37, a filter unit 40, and a communication channel 38. The circulation pump 37 can cause fluid to flow through the circulation channel 36. The filter unit 40 is part of the return channel 35 and replaceable. The communication channel 38 is connected to the return channel 35 so as to allow communication between the return channel 35 and the outside of the return channel 35 therethrough.

The circulation pump 37 is, for example, a tube pump. When the circulation pump 37 is rotated in one direction, a tube forming a channel is pressed so as to pump the fluid. When the circulation pump 37 is rotated in the opposite direction to the one direction, the pressing of the tube is released so as to allow the fluid to flow therethrough. A direction in which the liquid is pumped by the circulation pump 37 (indicated by arrows in FIG. 1) in the circulation channel 36 is referred to as a flowing direction. That is, the circulation pump 37 causes the fluid in the circulation channel 36 to flow in the flowing direction. The circulation pump 37 causes the fluid to circulate at such a pressure with which menisci formed in the nozzles 12 are not broken.

The circulation pump 37 may be a pump of another types such as a diaphragm pump. When printing is not performed, the liquid ejecting apparatus 11 drives the circulation pump 37 so as to cause the liquid to circulate through the circulation channel 36. This agitates the liquid, thereby suppressing or preventing sedimentation of the pigment or the like.

The filter unit 40 includes a filter 41 and an upstream filter chamber 42. Foreign matter is trapped by the filter 41. The liquid is accumulated in the upstream filter chamber 42 on the first side where the liquid has not yet passed the filter 41. It is preferable that the communication channel 38 is connected to the upstream filter chamber 42. Gas trapped by the filter 41 is accumulated in the upstream filter chamber 42. Thus, when the communication channel 38 is connected to the upstream filter chamber 42, the trapped gas is discharged to the outside through the communication channel 38.

When the filter 41 is used as an upstream filter, one of the filters 34 disposed at the downstream channel 15*c* extending from the second position P2 of the supply channel 15 to the nozzles 12 is used as a downstream filter. The filter 34 as the downstream filter may have a lower ability of trapping foreign matter than that of the filter 41 as the upstream filter.

The circulation pump 37 is disposed, for example, between the first position P1 and a connection position P3 where the communication channel 38 is connected to the return channel 35. The connection position P3 is disposed between the first end and the second end of the return channel 35. According to the present embodiment, in the return channel 35, part of the return channel 35 from the connection position P3 to the second position P2 is defined as a diversion channel 35*a*, and a region where the diversion channel 35*a* is provided is defined as "diversion region". Also in the return channel 35, part of the return channel 35 from the connection position P3 to the first position P1 is defined as a merging channel 35*b*, and a region where the merging channel 35*b* is provided (substantially a region surrounded by two-dot chain line in FIG. 1) is defined as "merging region".

It is preferable that a pressure sensor 60 that can detect the pressure in the return channel 35 included in the circulation channel 36 be provided in the diversion region. It is also preferable that the liquid ejecting apparatus 11 include either or both (both according to the present embodiment) of one-way valves 61, 62 that are provided in the circulation channel 36, allow the flow of the fluid in the flowing direction in the circulation channel 36, and suppress a flow of the fluid in the opposite direction to the flowing direction. It is preferable that the one-way valve 61, which allows the flow of the fluid from the second position P2 toward the filter unit 40 and suppresses the flow of the fluid in the opposite direction to this direction be disposed, for example, between the pressure sensor 60 and the filter unit 40 in the diversion region.

It is preferable that the one-way valve 62, which allows the flow of the fluid from the circulation pump 37 toward the first position P1 and suppresses the flow of the fluid in the opposite direction to this direction be disposed, for example, between the circulation pump 37 and the first position P1 in the merging region. Another liquid accumulating portion 63 is provided between the one-way valve 62 and the first position P1 in the merging region.

An opening/closing valve 39 is provided in the communication channel 38. The opening/closing valve 39 is opened so as to open the communication channel 38 when a gas discharge unit 46 or an adaptor 47 (see FIG. 8) is mounted. When the gas discharge unit 46 or the adaptor 47 is removed, the opening/closing valve 39 is closed so as to close the communication channel 38. When the gas discharge unit 46 is mounted, the communication channel 38 communicates with a discharge channel 48 provided in the gas discharge unit 46. When the adaptor 47 is mounted, the communication channel 38 communicates with the outside.

The gas discharge unit 46 includes the discharge channel 48, a flow-in regulator 49, and a gas-liquid separator 50. The discharge channel 48 allows the gas to be discharged to the outside. The flow-in regulator 49 can regulate entering of the fluid in the communication channel 38 from the outside. The gas-liquid separator 50 separates the gas and the liquid from each other. The flow-in regulator 49 is, for example, a one-way valve that allows the fluid to flow out from the communication channel 38 to the outside and regulates flowing of the gas (air) from the outside into the communication channel 38 and a backflow of the fluid from the inside of the discharge channel 48 toward the filter unit 40 side. The gas-liquid separator 50, which is provided downstream of the flow-in regulator 49, allows the gas to be discharged from the discharge channel 48 and regulates the liquid to be discharged from the discharge channel 48.

Figure 2:
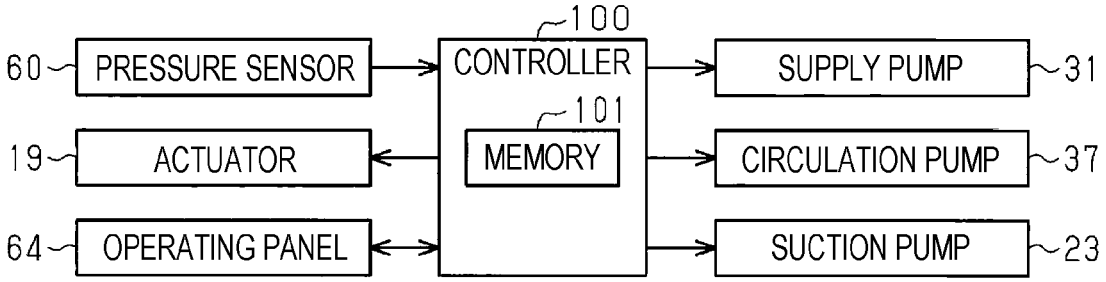
FIG. 2 is a block diagram illustrating an electrical configuration of the liquid ejecting apparatus illustrated in FIG. 1.

As illustrated in FIG. 2, the liquid ejecting apparatus 11 includes a controller 100 and an operating panel 64. The controller 100 controls elements including the actuators 19, the supply pumps 31, the circulation pump 37, and the suction pump 23. The operating panel 64 displays operating states of various elements and allows input of instructions. The controller 100 includes a memory 101 that stores a program used to control the elements. The controller 100 executes the program stored in the memory 101, thereby performing various processes. Furthermore, the controller 100 is electrically connected to the pressure sensor 60.

The controller 100 executes a process of estimating the degree of clogging of the filter 41 at specified timing. For example, when a pressure detected by the pressure sensor 60 while the circulation pump 37 is not being driven is defined as a first pressure and a pressure detected by the pressure sensor 60 while the circulation pump 37 is being driven is defined as a second pressure, the controller 100 causes the memory 101 to store the first pressure and the second pressure. Then, in the case where the difference between the first pressure and the second pressure is larger than a set threshold, the controller 100 determines that the filter 41 is clogged to such a degree that replacement of the filter 41 is necessary. At this time, the controller 100 functions as an estimating unit that estimates the degree of clogging of the filter 41 in accordance with an operating state of the circulation pump 37 and the pressure detected by the pressure sensor 60.

The threshold used for this determination may be calculated in advance through an experiment or a simulation and stored in the memory 101 included in the controller 100 or input by a user by using the operating panel 64 or the like. When the controller 100 determines that the filter 41 is clogged to such a degree that replacement of the filter 41 is necessary, the controller 100 notifies the user of this determination through the operating panel 64 or the like. Thus, the filter unit 40 is replaced at an appropriate time.

Next, an embodiment of the pressure adjustment mechanisms 70 is described.

Figure 3:
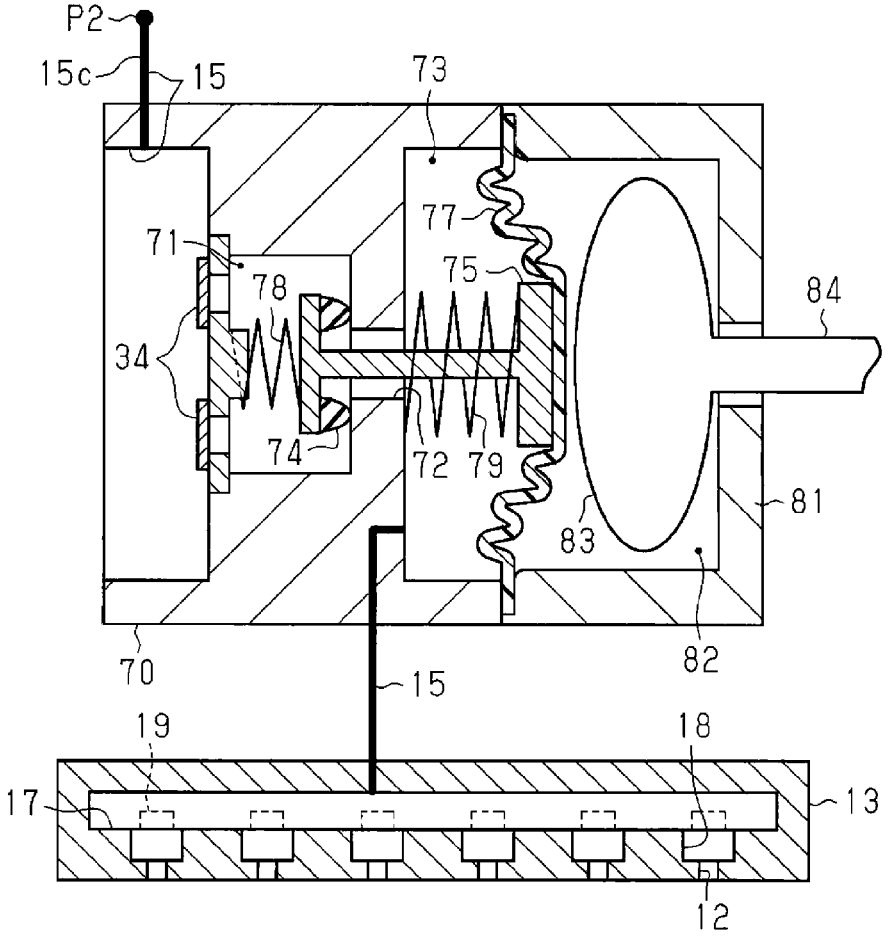
FIG. 3 is a sectional view of a pressure adjustment mechanism included in the liquid ejecting apparatus illustrated in FIG. 1.

As illustrated in FIG. 3, each of the pressure adjustment mechanisms 70 includes a supply chamber 71, a pressure chamber 73, a valve 74, and a pressure receiving member 75. The supply chamber 71 is provided partway along a corresponding one of the supply channels 15. The pressure chamber 73 can communicate with the supply chamber 71 through a communication hole 72. The valve 74 can open/close the communication hole 72. A proximal end of the pressure receiving member 75 is contained in the supply chamber 71 and a distal end of the pressure receiving member 75 is contained in the pressure chamber 73. The supply chamber 71, the communication hole 72, and the pressure chamber 73 are included in part of the supply channel 15 through which the liquid is supplied to the nozzles 12.

The valve 74 is, for example, an annular elastic member attached to the proximal end portion of the pressure receiving member 75 positioned in the supply chamber 71 so as to surround the proximal end portion. A corresponding of the filters 34 can be disposed, for example, at an inlet of the supply chamber 71. The pressure receiving member 75 can be separated at a portion along a bar-shaped portion thereof extending from a thin plate-shaped pressure receiving portion at the distal end of the pressure receiving member 75 toward the supply chamber 71, and separated part of the bar-shaped portion on the supply chamber 71 side may be integrated with the valve 74.

The up-down direction of the page of FIG. 3 corresponds to the vertical direction (gravity direction), and the lower side of the page corresponds to the lower side in the vertical direction.

Part of a wall of the pressure chamber 73 is formed of a flexible film 77 that can be bent. Furthermore, the pressure adjustment mechanism 70 includes a first urging member 78 contained in the supply chamber 71 and a second urging member 79 contained in the pressure chamber 73. The first urging member 78 urges the valve 74 through the pressure receiving member 75 in a direction in which the communication hole 72 is closed.

The pressure receiving member 75 is displaced by being pushed by the flexible film 77 that is bent in a direction in which the volume of the pressure chamber 73 is reduced. Furthermore, the flexible film 77 is bent in the direction in which the volume of the pressure chamber 73 is reduced when an inner pressure of the pressure chamber 73 is reduced due to discharge of the liquid from the nozzles 12. When a pressure (inner pressure) exerted on an inner surface of the flexible film 77 on the pressure chamber 73 side becomes lower than a pressure (outer pressure) exerted on an outer surface of the flexible film 77 opposite to the pressure chamber 73 and the difference between the pressure exerted on the inner surface and the pressure exerted on the outer surface becomes a set value (for example, 1 kPa) or larger, the pressure receiving member 75 is displaced, thereby the state of the valve 74 is changed from the closed state to the open state.

The set value is determined in accordance with urging forces of the first urging member 78 and the second urging member 79, a force required to displace the flexible film 77, a pressing force required to close the communication hole 72 with the valve 74 (sealing load), a pressure in the supply chamber 71 exerted on the supply chamber 71 side of the pressure receiving member 75 and the surface of the valve 74, and a pressure in the pressure chamber 73. That is, as the total of the urging forces of the first urging member 78 and the second urging member 79 increases, the set value increases. The urging forces of the first urging member 78 and the second urging member 79 are set so that, for example, the pressure in the pressure chamber 73 is a negative pressure in such a range that the menisci can be formed at the gas-liquid interfaces in the nozzles 12 (for example, −1 kPa in the case where the pressure exerted on the outer surface of the flexible film 77 is the atmospheric pressure).

When the communication hole 72 is open and the liquid flows from the supply chamber 71 into the pressure chamber 73, the inner pressure of the pressure chamber 73 increases.

Then, when the inner pressure of the pressure chamber 73 reaches the above-described set value, the valve 74 closes the communication hole 72. Thus, even when the liquid is pressurized to be supplied to the supply chamber 71, or the liquid is discharged from the nozzles 12, the pressure from the pressure chamber 73 to the cavities 18 (back pressure of the nozzles 12) is generally maintained at about the set value.

According to the present embodiment, the pressure adjustment mechanism 70 is disposed in the downstream channel 15*c* of the supply channel 15 extending from the second position P2 toward the liquid ejecting unit 13. The pressure adjustment mechanism 70 includes the valve 74 that can switch the state of the supply channel 15 between a communicating state and a non-communicating state. When the pressure in a region downstream of the valve 74 becomes lower than the set value that is smaller than the outside pressure, the valve 74 autonomously switches the state of the supply channel 15 (communication hole 72) from the communicating state to the non-communicating state. Accordingly, the pressure adjustment mechanism 70 is classified as a differential pressure valve (in particular, a pressure reduction valve among differential pressure valves).

A valve opening mechanism 81 that forcibly opens the communication hole 72 so as to supply the liquid to the liquid ejecting unit 13 may be added to the pressure adjustment mechanism 70. The valve opening mechanism 81 includes, for example, a pressurizing bag 83 and a pressurizing channel 84. The pressurizing bag 83 is accommodated in an accommodating chamber 82 separated from the pressure chamber 73 by the flexible film 77. The gas flows into the pressurizing bag 83 through the pressurizing channel 84. The gas flowing in through the pressurizing channel 84 causes the pressurizing bag 83 to inflate. This causes the flexible film 77 to be bent in a direction in which the volume of the pressure chamber 73 is reduced, thereby forcibly opening the communication hole 72. When the communication hole 72 is forced to be open by the valve opening mechanism 81, the state of the supply channel 15 (communication hole 72) can be forcibly switched from the non-communicating state to the communicating state.

Next, an embodiment of the filter unit 40 is described.

Figure 4:
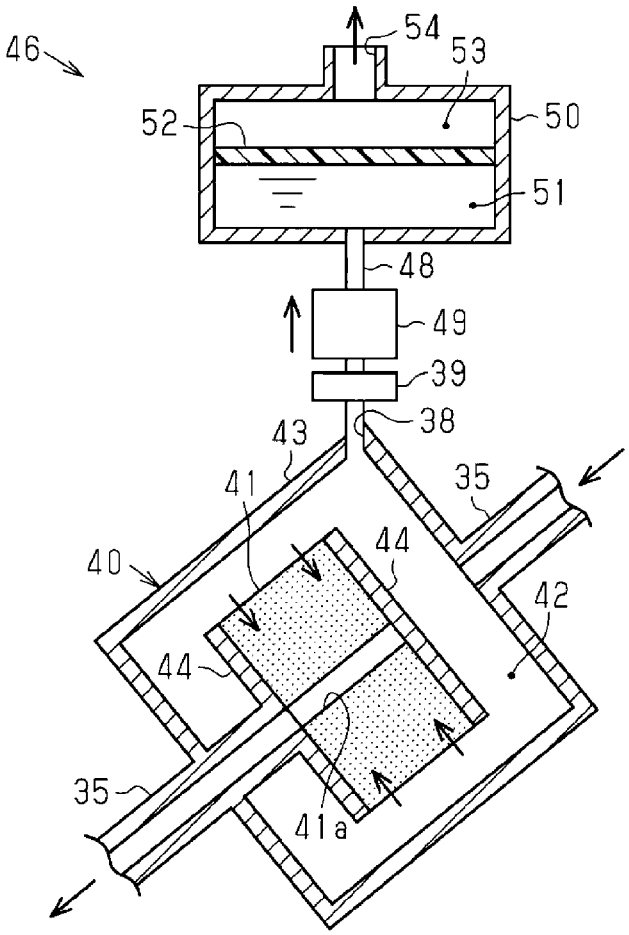
FIG. 4 is a sectional view of a filter unit and a flow-in regulator included in the liquid ejecting apparatus illustrated in FIG. 1.

As illustrated in FIG. 4, the filter unit 40 includes a cylindrical case 43. The filter 41 has a cylindrical shape and is disposed in the case 43 so as to be coaxial with the case 43. The return channel 35 is connected to the bottom surface and the top surface of the cylindrical case 43. The upstream filter chamber 42, which is formed between the case 43 and the filter 41 so as to surround the filter 41, is part of the return channel 35.

The up-down direction of the page of FIG. 4 corresponds to the vertical direction (gravity direction), and the lower side of the page corresponds to the lower side in the vertical direction.

The filter 41 has a hole 41*a* defined by an inner circumferential surface of the cylinder and is closed by discoidal support plates 44 at the bottom portion and the top portion thereof. An upper end of the hole 41*a* is closed by one of the support plates 44 on the top side. A lower end of the hole 41*a* penetrates through the other support plate 44 on the bottom side. A space in the hole 41*a* is the second side of the filter 41 and included in the merging region of the return channel 35.

It is preferable that the filter unit 40 be inclined such that the first side (upstream side) of the filter unit 40 is at a higher level than the second side (downstream side) of the filter unit 40. Furthermore, it is preferable that the communication channel 38 be connected to the upper end portion of the upstream filter chamber 42 in the vertical direction. In this way, the gas flowing into the upstream filter chamber 42 is accumulated at one of corner portions being an uppermost position of the upstream filter chamber 42. Thus, the gas is more likely to flow into the communication channel 38 than the liquid.

In the return channel 35, when the fluid flows from the diversion region upstream of the filter unit 40 into the filter unit 40, the fluid is temporarily accumulated in the upstream filter chamber 42. Then, the fluid flows into the filter 41 through an outer circumferential surface of the filter 41 so as to reach the hole 41*a*. At this time, foreign matter including bubbles is trapped by the filter 41. Furthermore, the bubbles trapped by the filter 41 are accumulated in an upper portion of the upstream filter chamber 42 and flow through the communication channel 38 and the discharge channel 48 to the outside of the channels. The liquid from which the foreign matter has been filtered out by the filter 41 is moved to the merging region downstream of the filter unit 40 through the hole 41*a*. In the structure illustrated in FIG. 4, the direction in which the fluid flows is indicated by arrows.

Next, an embodiment of the gas-liquid separator 50 is described.

As illustrated in FIG. 4, the gas-liquid separator 50 includes a deaerating chamber 51, a discharge chamber 53, and a discharge path 54. The liquid is temporarily stored in the deaerating chamber 51 at an end of the discharge channel 48. The discharge chamber 53 is separated from the deaerating chamber 51 by a deaerating film 52. The discharge path 54 allows the discharge chamber 53 to communicate with the outside. The deaerating film 52 has properties that allow gas to pass therethrough and that do not allow liquid to pass therethrough. The deaerating film 52 can be formed by, for example, forming a large number of very small holes of about 0.2 micrometers in a film produced by special extension of polytetrafluoroethylene (PTFE). When the liquid containing gas flows into the deaerating chamber 51, only the gas passes through the deaerating film 52 and flows into the discharge chamber 53. The gas having flowed into the discharge chamber 53 is discharged to the outside through the discharge path 54. Thus, bubbles and dissolved gas mixed into the liquid accumulated in the deaerating chamber 51 are removed while discharge of the liquid through the discharge channel 48 is suppressed.

Next, a method of discharging fluid using the liquid ejecting apparatus 11 is described.

Before the liquid ejecting apparatus 11 is started to be used, the gas is contained in the supply channel 15 connected from the liquid supply source 14 to the nozzles 12. Thus, an initial filling through which the gas is discharged and the supply channel 15 is filled with the liquid is performed. As the method of discharging fluid when performing the initial filling, the controller 100 executes the following initial filling process.

Figure 5:
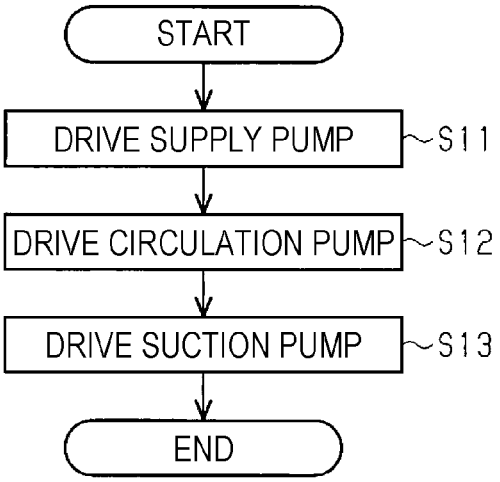
FIG. 5 is a flowchart illustrating an operating sequence when the liquid ejecting apparatus illustrated in FIG. 1 discharges fluid.

As illustrated in FIG. 5, first, the controller 100 drives the supply pump 31 for a specified period of time as a discharge step (step S11). This causes the liquid in the liquid supply source 14 to flow into the supply channel 15, and fluid (mainly gas) contained in a region from the liquid supply source 14 to the second position P2 in the supply channel 15 (the upstream channel 15*a* and the intermediate channel 15*b*) and the fluid (mainly gas) contained in a region from the second position P2 to the connection position P3 in the return channel 35 (diversion channel 35*a*) are discharged through the communication channel 38 and the gas discharge unit 46. At this time, the upstream channel 15*a*, the intermediate channel 15*b*, and the diversion channel 35*a* are filled with the liquid. At this stage, the gas still remains in the merging channel 35*b* and the downstream channel 15*c*.

Suction cleaning may be performed before the discharge step so as to fill the supply channel 15 with the liquid. In this case, instead of performing the suction cleaning, the supply pump 31 and the valve opening mechanism 81 may be driven so as to fill the supply channel 15 with the liquid.

After the discharge step has been performed, as a moving step, the controller 100 drives the circulation pump 37 for a specified period of time (step S12). This causes the fluid (mainly gas) contained in a region from the connection position P3 to the first position P1 in the return channel 35 (the merging region of the return channel 35 surrounded by a two-dot chain line in FIG. 1) to flow into the supply channel 15. At this time, the liquid is moved from the diversion region to the merging region of the return channel 35, thereby filling of the return channel 35 with the liquid is completed. At this stage, the gas having been moved from the merging region of the return channel 35 is contained in the supply channel 15, and the gas still remains in the downstream channel 15*c* of the supply channel 15 including the liquid ejecting unit 13.

Since the liquid filled in the intermediate channel 15*b* is moved to the diversion region of the return channel 35 in the moving step, an interior volume of the intermediate channel 15*b* is preferably larger than an interior volume of the merging region of the return channel 35. When the liquid is filled in the entirety of the supply channel 15 before the discharge step, the gas is unlikely to flow from the supply channel 15 into the return channel 35 in the moving step.

After the moving step has been performed, as a filling step, the controller 100 drives the suction pump 23 for a specified period of time in the capping state so as to perform suction cleaning (step S13). This causes the gas having moved from the return channel 35 to the supply channel 15 and the gas remaining in the downstream channel 15*c* of the supply channel 15 to be discharged from the nozzles 12 of the liquid ejecting unit 13. In the filling step, the supply pump 31 may be driven in addition to the suction pump 23. Alternatively, in the filling step, instead of driving the suction pump 23, supply pump 31 and the valve opening mechanism 81 are driven so as to pressurize the liquid to supply the liquid to the supply channel 15 and the liquid ejecting unit 13. By performing the filling step, the supply channel 15, the return channel 35, and the liquid ejecting unit 13 have been entirely filled with the liquid. Thus, the initial filling process is completed.

It is preferable that the liquid filling process to the channels be performed after replacement of the filter unit 40 in addition to the start of use of the liquid ejecting apparatus 11. When the filter unit 40 is replaced without draining the liquid from the supply channel 15 and the return channel 35, the moving step and the filling step can be performed with the discharge step omitted in the initial filling. Furthermore, in the case where the gas-liquid separator 50 is made to be a replaceable unit, it is preferable that the gas-liquid separator 50 be also replaced along with replacement of the filter unit 40 and filling of the liquid.

When the pressurized liquid flows from the upstream filter chamber 42 to the deaerating chamber 51 through the communication channel 38 and the discharge channel 48 during, for example, printing, the liquid may seep through the deaerating film 52. When there is a possibility of such seepage of the liquid, it is preferable that the gas discharge unit 46 be removed at a stage where the initial filling is completed. In this case, it is preferable that a new gas discharge unit 46 be mounted before replacement of the filter unit 40 and filling of the liquid.

Next, operation performed when the supply channel 15 and the return channel 35 are filled with the liquid in the liquid ejecting apparatus 11 structured as above is described.

When the supply pump 31 is driven in the discharge step of the initial filling process, the gas contained in the upstream channel 15*a* and the intermediate channel 15*b* of the supply channel 15 and the diversion channel 35*a* of the return channel 35 flows into the upstream filter chamber 42. The gas having flowed into the upstream filter chamber 42 is accumulated in the upper portion of the upstream filter chamber 42. Most of the gas flows into the deaerating chamber 51 of the gas-liquid separator 50 without passing through the filter 41 and passes through the deaerating film 52. Then, the gas having passed through the deaerating film 52 flows to the outside of the channel through the discharge chamber 53 and the discharge path 54.

When the liquid flows into the deaerating chamber 51 together with the gas in the discharge step, passage of the liquid is blocked by the deaerating film 52 and the liquid remains in the deaerating chamber 51. When the gas is discharged from the upstream filter chamber 42 in this manner, the upstream filter chamber 42 is filled with the liquid.

When the circulation pump 37 is driven in the moving step, the diversion region side of the return channel 35 is sucked and the liquid flows into the upstream filter chamber 42. The liquid having flowed into the upstream filter chamber 42 is sucked by the circulation pump 37 so as to pass through the filter 41 and flow into the hole 41*a* on the second side. At this time, the gas is contained in the merging region downstream of the filter 41. However, the gas existing downstream of the filter 41 cannot flow out through the communication channel 38. Thus, the gas flows into the supply channel 15 from the first position P1. In place of the gas flowing into the supply channel 15, the merging region of the return channel 35 is filled with the liquid flowing from the intermediate channel 15*b* of the circulation channel 36.

Here, when the one-way valve 62 is provided so as to prevent the backflow of the liquid in the return channel 35, driving the suction pump 23 cannot fill the return channel 35 with the liquid. However, the return channel 35 is filled with the liquid by performing the discharge step and the moving step. Furthermore, in the discharge step, the gas is pushed by the liquid into the upstream filter chamber 42 and preferentially drained from the top side of the upstream filter chamber 42. This reduces the amount of discharge of the liquid compared to the case where the gas and the liquid are discharged together by suction cleaning.

In the filling step, the gas remaining in the supply channel 15 is discharged from the nozzles 12 by driving the suction pump 23. At this time, it is sufficient that the liquid discharged together with the gas be only the liquid contained in a region of the intermediate channel 15*b* that does not contain the gas moved from the return channel 35 (substantially the amount of liquid corresponding to the difference in interior volume between the intermediate channel 15*b* and the merging region of the return channel 35). Thus, in the initial filling, the amount of the liquid consumed along with the discharge of the gas can be small.

Furthermore, after the initial filling, when the liquid is circulated through the circulation channel 36 during, for example, intervals between printing, the liquid is agitated and foreign matter is trapped by the filter 41 in the return channel 35. Thus, the liquid from which the foreign matter has been filtered out is returned to the intermediate channel 15*b* and supplied to the liquid ejecting unit 13. Furthermore, the gas trapped by the filter 41 or the gas accumulated on the upper side of the upstream filter chamber 42 due to a buoyant force can be discharged from the upper portion of the upstream filter chamber 42 to the outside. Thus, the gas is removed from the intermediate channel 15*b* included in the circulation channel 36.

Next, a method of discharging liquid using the liquid ejecting apparatus 11 is described. Some liquid ejecting apparatuses 11 are filled with liquid (for example, a filling liquid) that does not contain colorant such as a pigment before they are started to be used. In the initial filling process in such a liquid ejecting apparatus 11, the supply channel 15 is filled with the liquid such as ink in the initial filling after the filling liquid has been discharged. Furthermore, in the liquid ejecting apparatus 11 in which the supply channel 15 and the return channel 35 are filled with the liquid such as ink by performing the initial filling, the liquid with which the supply channel 15 and the return channel 35 are filled may be discharged when, for example, the filter unit 40 or the circulation pump 37 is replaced or the type of the liquid is changed. The liquid ejecting apparatus 11 performs a liquid discharge process when discharging the liquid in the supply channel 15 and the return channel 35 and replacing the liquid with another fluid such as the air.

Figure 6:
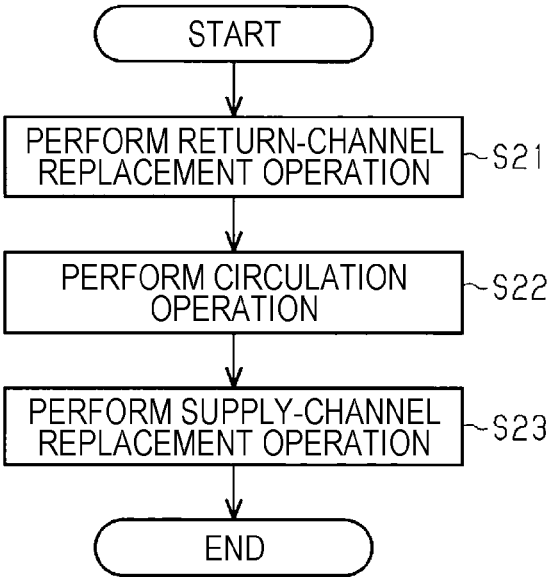
FIG. 6 is a flowchart illustrating an operating sequence when the liquid ejecting apparatus illustrated in FIG. 1 discharges liquid.

As illustrated in FIG. 6, the controller 100 causes a return-channel replacement operation (step S21), a circulation operation (step S22), and a supply-channel replacement operation (step S23) to be performed. That is, the controller 100 causes the circulation operation to be performed after the return-channel replacement operation has been performed and the supply-channel replacement operation to be performed after the return-channel replacement operation and the circulation operation have been performed.

Next, operation performed when discharging the liquid with which the supply channel 15 and the return channel 35 are filled in the liquid ejecting apparatus 11 is described.

The up-down direction of the pages of FIGS. 7 to 10 corresponds to the vertical direction (gravity direction), and the lower side of the page corresponds to the lower side in the vertical direction.

Figure 7:
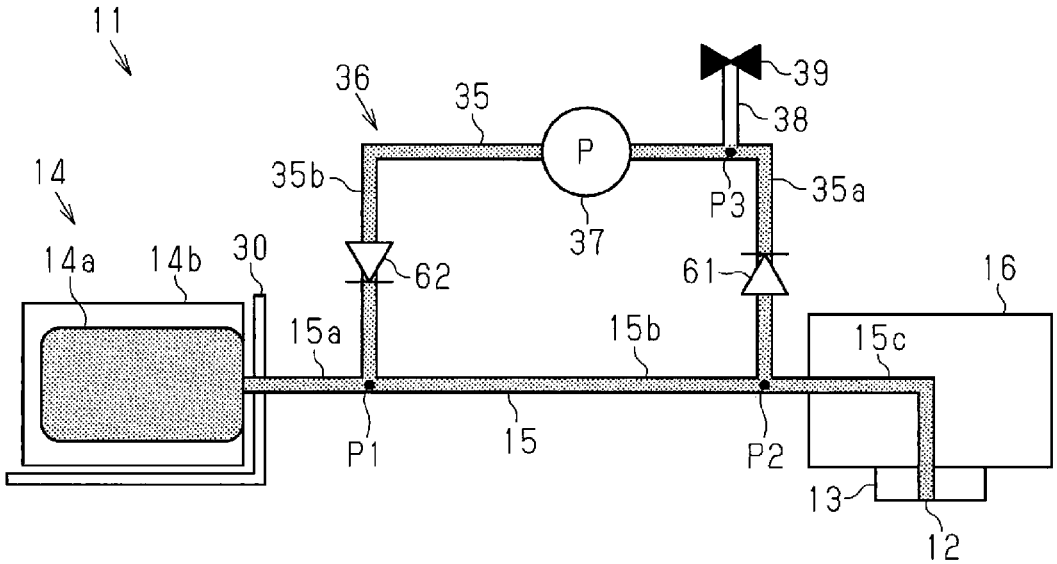
FIG. 7 is a schematic view of the liquid ejecting apparatus illustrated in FIG. 1 before a return-channel replacement operation is performed.

As illustrated in FIG. 7, the liquid is contained in the supply channel 15 and the return channel 35 at a time before the return-channel replacement operation is performed such as a time of printing. The gas discharge unit 46 has been removed from the liquid ejecting apparatus 11. Accordingly, the opening/closing valve 39 is closed and the return channel 35 does not communicate with the outside.

Figure 8:
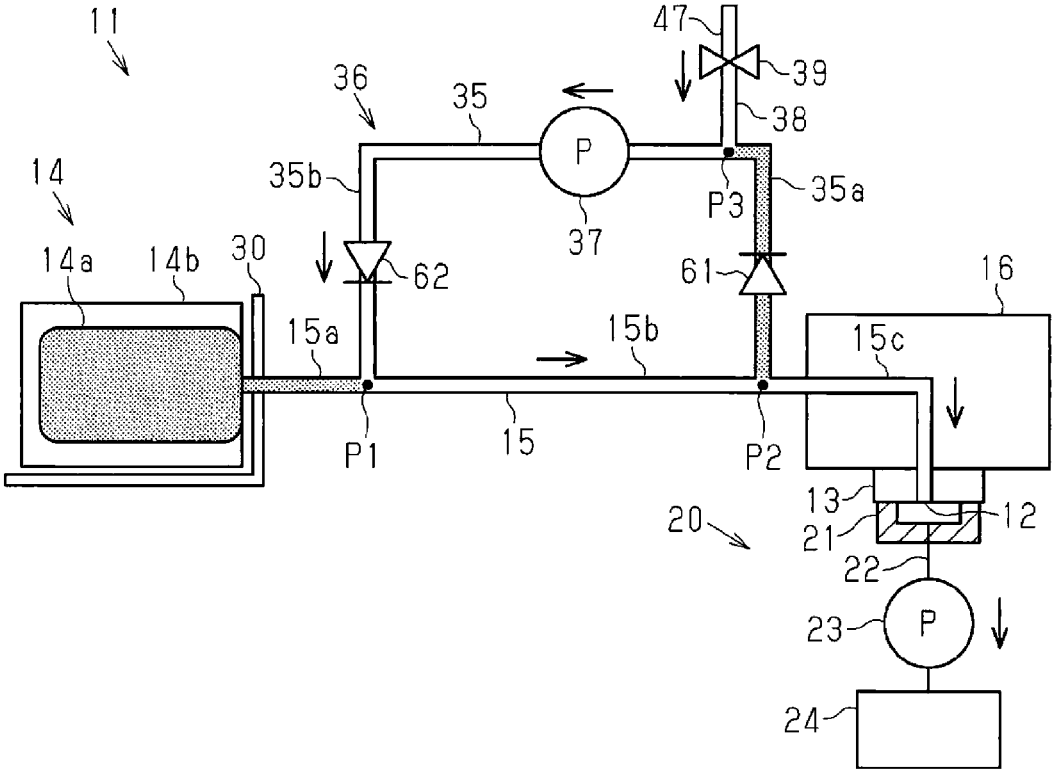
FIG. 8 is a schematic view of the liquid ejecting apparatus illustrated in FIG. 1 during the return-channel replacement operation.

As illustrated in FIG. 8, in the return-channel replacement operation, first, the adaptor 47 is mounted in the communication channel 38 so as to open the opening/closing valve 39. When the opening/closing valve 39 is open, the return channel 35 communicates with the outside through the communication channel 38. The liquid supply source 14 is connected to an upstream end of the supply channel 15.

While the return channel 35 communicates with the outside through the communication channel 38 and the upstream end of the supply channel 15 does not communicate with the outside, the controller 100 drives the suction pump 23 and the circulation pump 37, thereby causing the liquid in the return channel 35 to be discharged toward the supply channel 15 side. In this regard, the suction pump 23 and the circulation pump 37 function as pumps that can cause the fluid in the circulation channel 36 to flow.

When the suction pump 23 and the circulation pump 37 are driven, as indicated by arrows in FIG. 8, the liquid is discharged from the liquid ejecting unit 13 and the air flows into the return channel 35 through the communication channel 38. As a result, the liquid in the merging channel 35*b* is moved to the intermediate channel 15*b*, and further, ejected from the nozzles 12 to the outside through the downstream channel 15*c*. Thus, the liquid is discharged and replaced with the air in the merging channel 35*b*, the intermediate channel 15*b*, and the downstream channel 15*c*, and the liquid remains in the diversion channel 35*a* and the upstream channel 15*a*.

The return-channel replacement operation may be performed by driving the suction pump 23 and setting the circulation pump 37 in a non-drive state. When the circulation pump 37 is set in a non-drive state while flowing of the fluid is allowed, the liquid in the merging channel 35*b* can be discharged to the supply channel 15 side by driving the suction pump 23 in the liquid ejecting apparatus 11.

Figure 9:
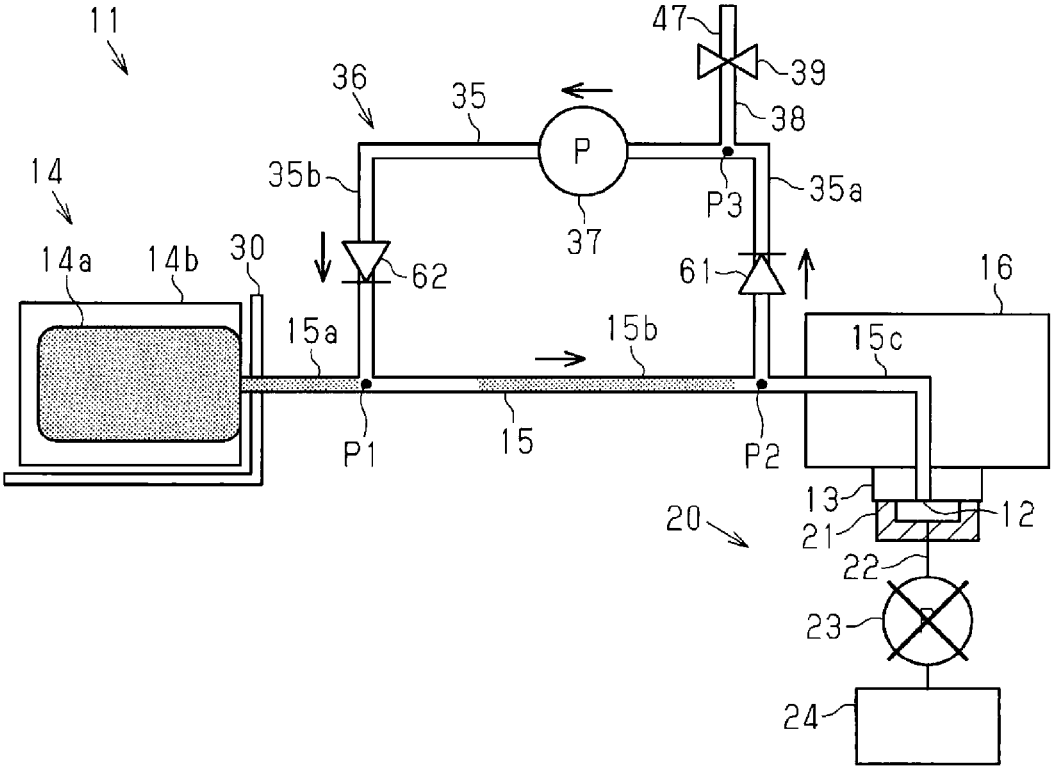
FIG. 9 is a schematic view of the liquid ejecting apparatus illustrated in FIG. 1 during a circulation operation.

As illustrated in FIG. 9, in the circulation operation, the controller 100 drives the circulation pump 37 and sets the suction pump 23 in a non-drive state. When the circulation pump 37 is driven, as indicated by arrows in FIG. 9, the fluid is circulated in the circulation channel 36, thereby the liquid remaining in the diversion channel 35*a* is moved to the intermediate channel 15*b*. The circulation operation may be performed by driving the circulation pump 37 in a state in which the adaptor 47 is removed from the communication channel 38, thereby the opening/closing valve 39 is closed so as to block communication between the return channel 35 and the outside.

Figure 10:
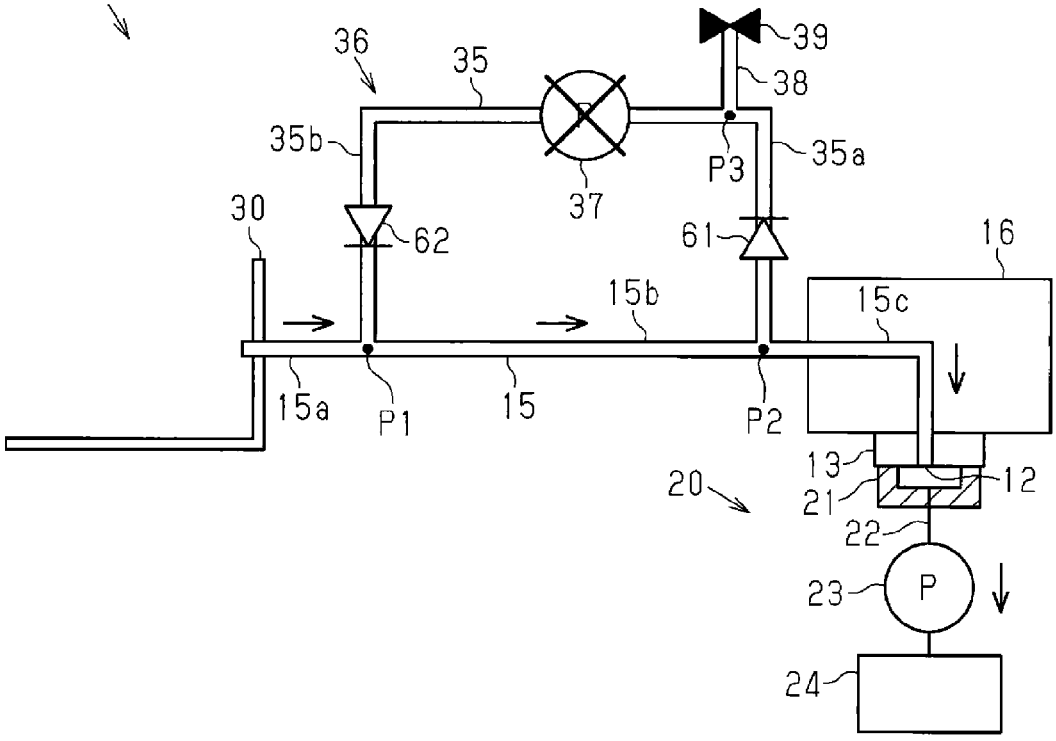
FIG. 10 is a schematic view of the liquid ejecting apparatus illustrated in FIG. 1 during a supply-channel replacement operation.

As illustrated in FIG. 10, in the supply-channel replacement operation, the adaptor 47 is removed from the communication channel 38 so as to close the opening/closing valve 39, and the liquid supply source 14 is removed from the mounting portion 30. That is, the controller 100 drives the suction pump 23 in a state in which the return channel 35 does not communicate with the outside and the upstream end of the supply channel 15, to which the liquid supply source 14 is connectable, communicates with the outside. At this time, the controller 100 may drive the supply pump 31 (see FIG. 1) or the blower pump with a discharging attachment connected to the upstream end of the supply channel 15. The discharging attachment allows the air blown from the blower pump to be discharged. The circulation pump 37 is set in the non-drive state with the tube pressed so as to limit flowing of the fluid therethrough or the pressing of the tube released so as to allow the fluid to flow therethrough.

When the suction pump 23 is driven, as indicated by arrows in FIG. 10, the air flows from the upstream end of the supply channel 15 into the supply channel 15 and the liquid in the supply channel 15 is discharged to the outside through the liquid ejecting unit 13.

The following effects can be obtained according to the above-described embodiment.

1. In the return-channel replacement operation, the pumps are driven in a state in which the return channel 35 included in the circulation channel 36 communicates with the outside. Thus, the liquid is caused to flow while the air is introduced into the return channel 35. This allows the liquid in the return channel 35 to be easily replaced with the air. Accordingly, the liquid in the circulation channel 36 can be efficiently discharged.

2. In the supply-channel replacement operation, the suction pump 23 is driven in a state in which the upstream end of the supply channel 15 communicates with the outside. Thus, the liquid in the supply channel 15 is caused to flow while the air is introduced from the upstream end of the supply channel 15. This allows the liquid in the supply channel 15 to be easily replaced with the air. Accordingly, the liquid having been discharged to the supply channel 15 side by the return-channel replacement operation can be efficiently discharged from the supply channel 15.

3. In the return-channel replacement operation, the suction pump 23 is driven so as to cause the fluid in the liquid ejecting unit 13 to be discharged to the outside while the return channel 35 communicates with the outside. Thus, the liquid moved from the return channel 35 to the supply channel 15 is discharged to the outside through the liquid ejecting unit 13. Accordingly, the return-channel replacement operation and the supply-channel replacement operation can be efficiently performed.

4. In the return-channel replacement operation, the pumps are driven in a state in which the return channel 35 communicates with the outside and the upstream end of the supply channel 15 does not communicate with the outside. Thus, compared to the case where the pumps are driven in a state in which the upstream end of the supply channel 15 communicates with the outside, flowing of the liquid from the return channel 35 to the supply channel 15 side can be stabilized.

5. In the return-channel replacement operation, the liquid may remain in the return channel 35. In this regard, since the circulation operation is performed after the return-channel replacement operation has been performed, the liquid remaining in the return channel 35 can be moved to the supply channel 15 by the circulation operation, and further, discharged to the outside by the supply-channel replacement operation.

6. The liquid ejecting apparatus 11 includes the one-way valves 61, 62 and the circulation pump 37 provided in the circulation channel 36. The circulation pump 37 causes the fluid to flow in a flowing direction in which the one-way valves 61, 62 allow the fluid to flow. Accordingly, the fluid can stably flow through the circulation channel 36.

The above-described embodiment may be modified to modifications as described below. The above-described embodiment and the modifications may be arbitrarily combined. Also, elements included in the following modifications may be arbitrarily combined.

The up-down direction of the pages of FIGS. 11 to 17 corresponds to the vertical direction (gravity direction), and the lower side of the page corresponds to the lower side in the vertical direction.

Figure 11:
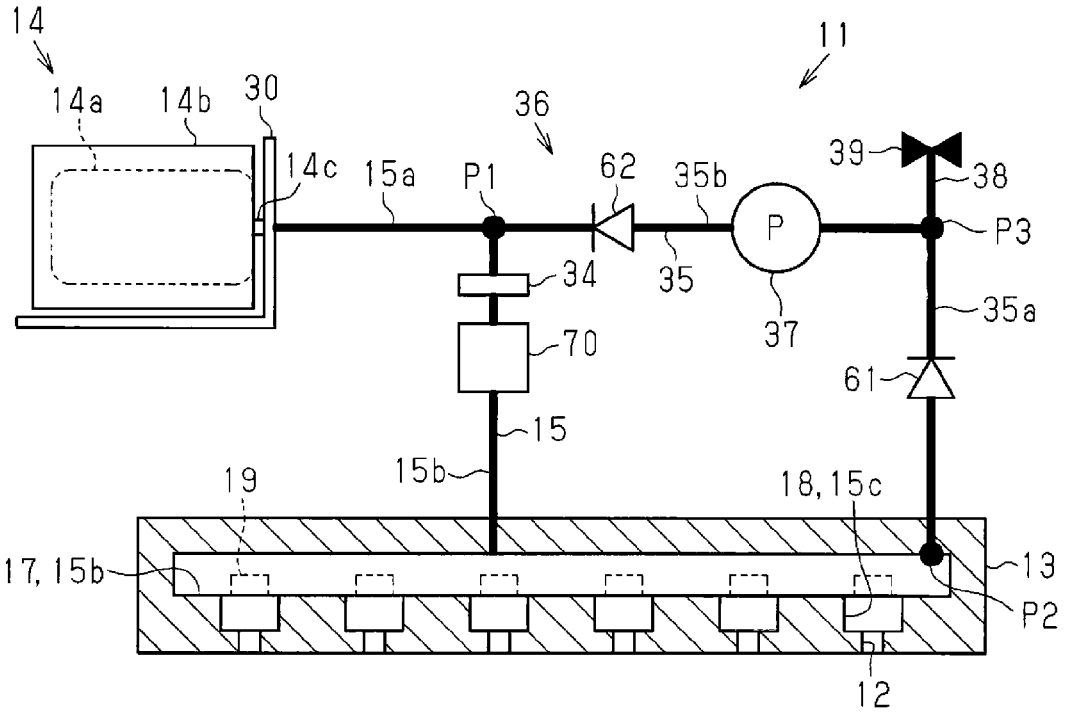
FIG. 11 is a schematic view of a liquid ejecting apparatus according to a first modification.

As illustrated in FIG. 11, the second end of the return channel 35 may be connected to the supply channel 15 in the liquid ejecting unit 13 (first modification). For example, the second end of the return channel 35 may be connected to the common liquid chamber 17 included in the supply channel 15. In this case, the common liquid chamber 17 functions as the intermediate channel 15*b*, and the cavities 18 function as the downstream channel 15*c*.

The liquid ejecting apparatus 11 does not necessarily include the supply pump 31 or the one-way valves 32, 33. The liquid ejecting apparatus 11 may utilize, for example, head of water to supply the liquid from the liquid supply source 14 to the liquid ejecting unit 13.

Figure 12:
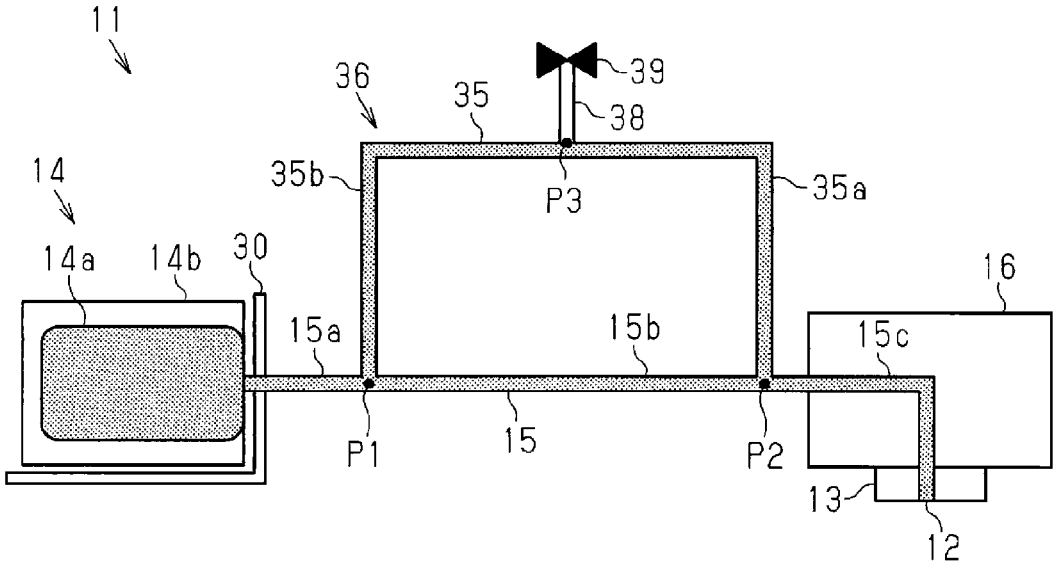
FIG. 12 is a schematic view of a liquid ejecting apparatus according to a second modification before the return-channel replacement operation is performed.
Figure 13:
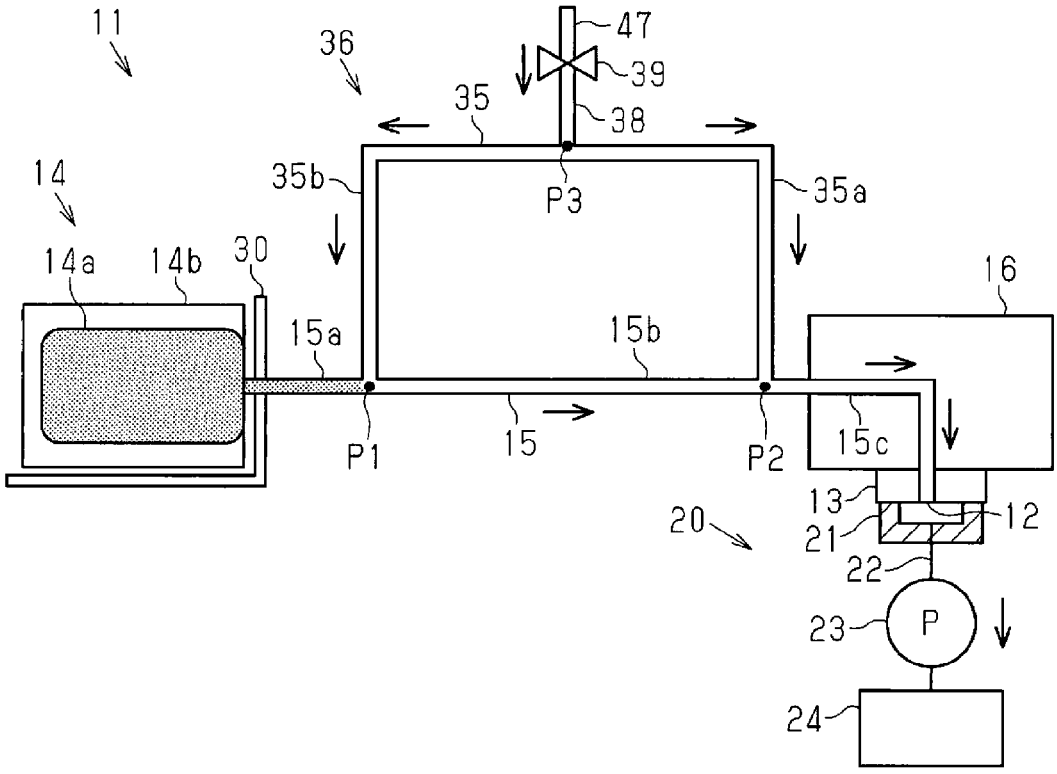
FIG. 13 is a schematic view of the liquid ejecting apparatus illustrated in FIG. 12 during the return-channel replacement operation.
Figure 14:
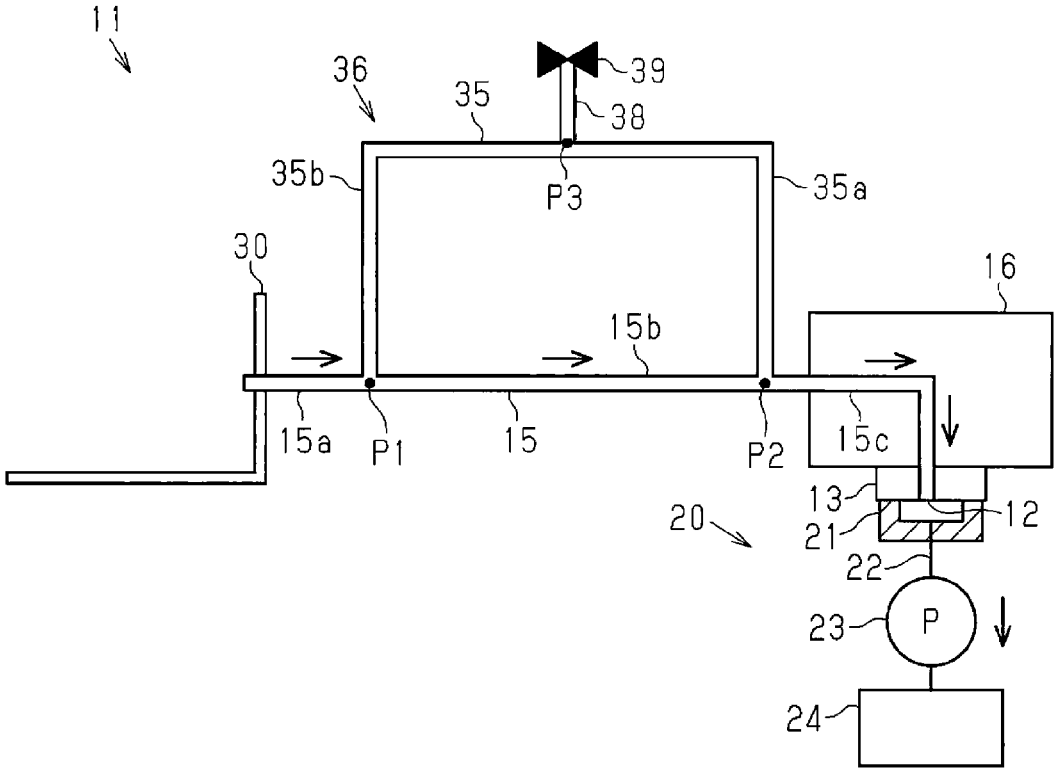
FIG. 14 is a schematic view of the liquid ejecting apparatus illustrated in FIG. 12 during the supply-channel replacement operation.

As illustrated in FIGS. 12 to 14, the liquid ejecting apparatus 11 may perform the return-channel replacement operation and the supply-channel replacement operation by using the suction pump 23 (second modification). The liquid ejecting apparatus 11 does not necessarily includes the one-way valves 61, 62 provided in the circulation channel 36. The liquid ejecting apparatus 11 does not necessarily perform the circulation operation. That is, the liquid ejecting apparatus 11 may perform the supply-channel replacement operation after performing the return-channel replacement operation, thereby discharging the liquid in the supply channel 15 and the return channel 35. When the liquid ejecting apparatus 11 performs the return-channel replacement operation and the supply-channel replacement operation by using the suction pump 23, the circulation pump 37 may be set in a non-drive state while flowing of the fluid is allowed. The liquid ejecting apparatus 11 does not necessarily include the circulation pump 37.

Specifically as illustrated in FIG. 12, the liquid is contained in the supply channel 15 and the return channel 35 during printing performed before the return-channel replacement operation is performed. The opening/closing valve 39 is closed and the communication channel 38 does not communicate with the outside.

As illustrated in FIG. 13, in the return-channel replacement operation, the liquid ejecting apparatus 11 drives the suction pump 23 in a state in which the return channel 35 communicates with the outside due to opening of the opening/closing valve 39 and the upstream end of the supply channel 15 does not communicate with the outside. When the flow resistance of the merging channel 35*b* and the intermediate channel 15*b* is substantially equal to the flow resistance of the diversion channel 35*a*, the liquid in the diversion channel 35*a*, the merging channel 35*b*, the intermediate channel 15*b*, and the downstream channel 15*c* is discharged to the outside through the liquid ejecting unit 13, and the liquid remains in the upstream channel 15*a*.

As illustrated in FIG. 14, in the supply-channel replacement operation, the liquid ejecting apparatus 11 drives the suction pump 23 in a state in which the return channel 35 does not communicate with the outside and the upstream end of the supply channel 15 communicates with the outside. This causes the liquid remaining in the upstream channel 15*a* to be discharged to the outside through the liquid ejecting unit 13.

Figure 15:
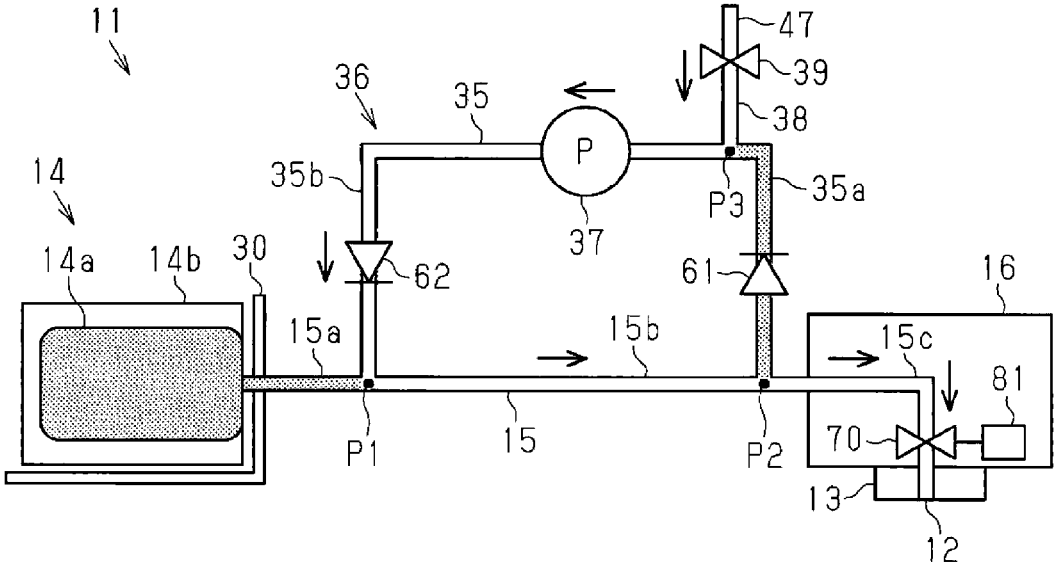
FIG. 15 is a schematic view of a liquid ejecting apparatus according to a third modification during the return-channel replacement operation.
Figure 16:
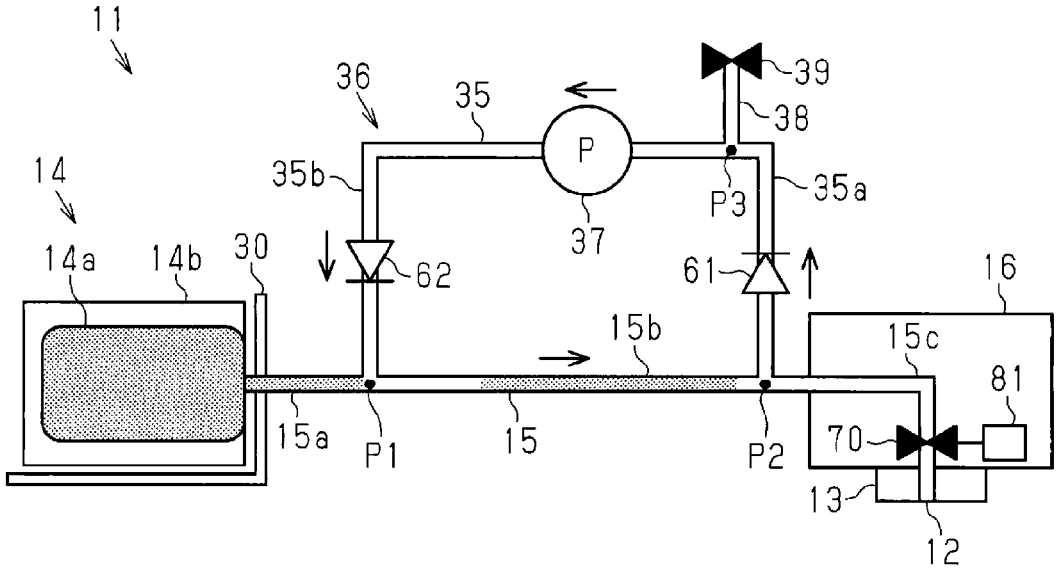
FIG. 16 is a schematic view of the liquid ejecting apparatus illustrated in FIG. 15 during a circulation operation.
Figure 17:
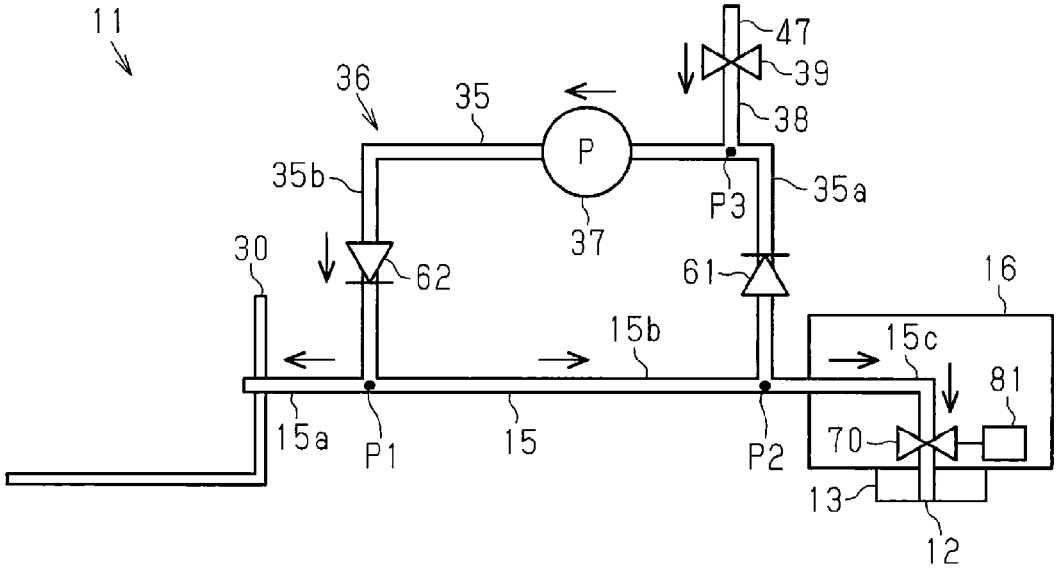
FIG. 17 is a schematic view of the liquid ejecting apparatus illustrated in FIG. 15 during the supply-channel replacement operation.

As illustrated in FIGS. 15 to 17, the liquid ejecting apparatus 11 may perform the return-channel replacement operation, the circulation operation, and the supply-channel replacement operation by using the circulation pump 37 (third modification). That is, the liquid ejecting apparatus 11 may perform the return-channel replacement operation and the supply-channel replacement operation without driving the suction pump 23. The liquid ejecting apparatus 11 does not necessarily include the suction pump 23. As illustrated in FIG. 7, the supply channel 15 and the return channel 35 in the liquid ejecting apparatus 11 is filled with the liquid before the return-channel replacement operation is performed.

As illustrated in FIG. 15, in the return-channel replacement operation, the liquid ejecting apparatus 11 sets the supply channel 15 in a communicating state by using the valve opening mechanism 81, causes the return channel 35 to communicate with the outside by opening the opening/closing valve 39, and blocks communication between the upstream end of the supply channel 15 and the outside. In this state, the controller 100 drives the circulation pump 37. As a result, the liquid in the merging channel 35*b*, the intermediate channel 15*b*, and the downstream channel 15*c* is discharged to the outside through the liquid ejecting unit 13. The liquid may remain in the upstream channel 15*a* and the diversion channel 35*a*.

As illustrated in FIG. 16, in the circulation operation, the liquid ejecting apparatus 11 blocks communication between the return channel 35 and the outside by closing the opening/closing valve 39 and sets the supply channel 15 in a non-communicating state by using the valve opening mechanism 81. In this state, the controller 100 drives the circulation pump 37. This causes the fluid to be circulated in the circulation channel 36, thereby the liquid remaining in the diversion channel 35*a* is moved to the intermediate channel 15*b*.

As illustrated in FIG. 17, in the supply-channel replacement operation, the liquid ejecting apparatus 11 causes the return channel 35 to communicate with the outside, causes the upstream end of the supply channel 15 to communicate with the outside, and sets the supply channel 15 in a communicating state by using the valve opening mechanism 81. In this state, the controller 100 drives the circulation pump 37. As a result, the liquid remaining in the upstream channel 15*a* is discharged from the upstream end of the supply channel 15 to the outside, and the liquid remaining in the intermediate channel 15*b* is discharged to the outside through the liquid ejecting unit 13.

In the supply-channel replacement operation, the supply pump 31 may be driven with the supply channel 15 set in the communicating state by using the valve opening mechanism 81. In the case where the supply pump 31 is driven in a state in which the return channel 35 does not communicate with the outside and the upstream end of the supply channel 15 communicates with the outside, the liquid in the supply channel 15 is discharged to the outside through the liquid ejecting unit 13.

A branch channel that is branched from the supply channel 15 and communicates with the outside may be provided so as to discharge the liquid therethrough to the outside in the return-channel replacement operation and the supply-channel replacement operation. That is, the liquid may be discharged not through the liquid ejecting unit 13.

The liquid ejecting apparatus 11 may include a valve that switches the communicating state between the upstream end of the supply channel 15 and the outside. The upstream end of the supply channel 15 may be caused to communicate with the outside by opening this valve, and the communication between the upstream end of the supply channel 15 and the outside may be blocked by closing this valve.

The circulation pump 37 may be disposed at a position between the connection position P3 and the second position P2 in the return channel 35 (diversion region). Furthermore, the circulation pump 37 may be disposed at a position between the pressure sensor 60 and the second position P2 in the return channel 35 (diversion region). In this case, when the pressure detected by the pressure sensor 60 while the circulation pump 37 is being driven becomes larger than the set threshold, the controller 100 may determine that the filter 41 is clogged to such a degree that replacement of the filter 41 is necessary.

The supply pump 31 may be used for causing the liquid in the circulation channel 36 to flow without providing the circulation pump 37 in the return channel 35. In the case where the pressure adjustment mechanism 70 is provided, even when pressure is applied to part of the supply channel 15 upstream of the supply chamber 71 by driving the supply pump 31, the liquid is not supplied to the liquid ejecting unit 13 as long as the inner pressure of the pressure chamber 73 does not become the set value being a negative pressure. When the supply pump 31 is driven while the pressure adjustment mechanism 70 is adjusting the pressure for supplying the liquid to the liquid ejecting unit 13 as described above, the liquid flowing through the intermediate channel 15*b* flows into the return channel 35 from the second position P2 instead of being directed to a downstream region of the supply channel 15. Thus, the liquid is circulated through the circulation channel 36.

A driving mode of the circulation pump 37 may vary in accordance with the degree of clogging of the filter 41. For example, when the filter 41 is clogged to such a degree that replacement of the filter 41 is necessary, the flow rate of the fluid flowing through the circulation channel 36 due to driving of the circulation pump 37 is reduced compared to the case where the filter 41 is not clogged. This can reduce an increase in pressure in the circulation channel 36.

The circulation pump 37 may be intermittently driven so as to cause the fluid in the circulation channel 36 to pulsate. For example, when agitating the liquid in the circulation channel 36 so as to suppress or eliminate sedimentation of the pigment or the like, it is preferable that the circulation pump 37 be intermittently driven so as to cause the fluid in the circulation channel 36 to pulsate, and when discharging the gas from the circulation channel 36 in, for example, the initial filling, it is preferable that the circulation pump 37 be continuously driven.

The flow rate of the fluid flowing through the circulation channel 36 due to drive of the circulation pump 37 may be varied between the case where the sedimentation of the pigment or the like is suppressed or eliminated and the case where the gas is discharged from the circulation channel 36 in, for example, the initial filling. For example, the flow rate may set to be larger in the case where the gas is discharged from the circulation channel 36 than in the case where the sedimentation of the pigment or the like is suppressed or eliminated.

In the cleaning in which the supply pump 31 and the valve opening mechanism 81 are driven so as to discharge the fluid in the supply channel 15 from the nozzles 12, the circulation pump 37 may also be driven so as to increase the pressure in the supply channel 15.

The liquid ejecting apparatus 11 does not necessarily includes the one-way valves 61, 62. The circulation pump 37 may cause the fluid to flow through the return channel 35 in a direction directed from the first position P1 to the second position P2.

In the case where the flow resistance of the upstream channel 15*a* is larger than the flow resistance of the merging channel 35*b* and the communication channel 38, the liquid ejecting apparatus 11 may perform the return-channel replacement operation in a state in which the return channel 35 is caused to communicate with the outside and the upstream end of the supply channel 15 is caused to communicate with the outside.

In the case where the flow resistance of the merging channel 35*b* and the communication channel 38 is larger than the flow resistance of the upstream channel 15*a*, the liquid ejecting apparatus 11 may perform the supply-channel replacement operation in a state in which the return channel 35 is caused to communicate with the outside and the upstream end of the supply channel 15 is caused to communicate with the outside.

The liquid ejecting apparatus 11 may drive the suction pump 23 so as to perform the supply-channel replacement operation in a state in which the return channel 35 is caused to communicate with the outside, the upstream end of the supply channel 15 is caused to communicate with the outside, and the tube is squeezed by the circulation pump 37 so as to set the return channel 35 in a non-communicating state.

The medium S is not limited to the sheet of paper. The medium S may be a plastic film, a thin plate, or the like or fabric used for a textile printing apparatus.

The liquid ejected by the liquid ejecting unit 13 is not limited to ink and may be, for example, a liquid material or the like formed by mixing or dispersing particles of a functional material in the liquid. For example, a material to be ejected for recording may be a liquid material including a material such as an electrode material or colorant (pixel material) used for the manufacture or the like of a liquid crystal display, an electroluminescent (EL) display, or a surface emitting display dispersed or dissolved in the liquid material.

The entire disclosure of Japanese Patent Application No. 2017-176531, filed Sep. 14, 2017 is expressly incorporated by reference herein.

What is claimed is:

1. A liquid ejecting apparatus, comprising:

a liquid ejecting unit that ejects liquid from a nozzle;

a pump; and a controller, wherein the liquid ejecting apparatus has a supply channel designed to be able to supply the liquid from a liquid supply source to the nozzle, a return channel that has ends connected to the supply channel and that forms, together with the supply channel, a circulation channel, and a communication channel that is connected to the return channel and that allows communication between an inside of the return channel and an outside, wherein the pump is designed to cause fluid in the circulation channel to flow, and wherein, in a state in which the return channel communicates with the outside through the communication channel, the controller drives the pump to perform a return-channel replacement operation in which the liquid in the return channel is discharged to the supply channel side.

2. The liquid ejecting apparatus according to claim 1, further comprising:

a suction pump that functions as the pump and that applies a negative pressure to the liquid ejecting unit to discharge the fluid in the liquid ejecting unit to the outside, wherein, after the return-channel replacement operation has been performed, in a state in which the return channel does not communicate with the outside and an upstream end of the supply channel, to which the liquid supply source is connectable, communicates with the outside, the controller drives the suction pump to perform a supply-channel replacement operation in which the liquid in the supply channel is discharged through the liquid ejecting unit.

3. The liquid ejecting apparatus according to claim 2, wherein the controller drives the suction pump to perform the return-channel replacement operation.

4. The liquid ejecting apparatus according to claim 1, wherein the controller causes the return-channel replacement operation to be performed in a state in which an upstream end of the supply channel does not communicate with the outside.

5. The liquid ejecting apparatus according to claim 1, wherein the return channel has a first end and a second end located on an opposite side to the first end, and the first end is connected to a first position of the supply channel and the second end is connected to a second position of the supply channel closer to the nozzle than the first position, wherein a circulation pump that functions as the pump is disposed between the first position and a connection position of the return channel where the communication channel is connected, wherein, after the return-channel replacement operation has been performed, in a state in which the return channel does not communicate with the outside, the controller causes a circulation operation in which the circulation pump is driven to be performed, and wherein, after the circulation operation has been performed, a supply-channel replacement operation in which the liquid in the supply channel is discharged to the outside is performed.

6. The liquid ejecting apparatus according to claim 1, further comprising:

a one-way valve that is provided in the circulation channel, that allows a flow of the fluid in a flowing direction in the circulation channel, and that suppresses a flow of the fluid in an opposite direction to the flowing direction, wherein a circulation pump that functions as the pump causes the fluid in the circulation channel to flow in the flowing direction.

7. A method of discharging liquid in a liquid ejecting apparatus, the liquid ejecting apparatus including:

a liquid ejecting unit that ejects liquid from a nozzle, a supply channel designed to supply the liquid from a liquid supply source to the nozzle, a return channel that has ends connected to the supply channel and that forms, together with the supply channel, a circulation channel, and a communication channel that is connected to the return channel and that allows communication between an inside of the return channel and an outside, wherein the method including:

performing, in a state in which the return channel communicates with the outside through the communication channel, a return-channel replacement operation in which the liquid in the return channel is discharged to the supply channel side.

8. The method according to claim 7, wherein, after the return-channel replacement operation has been performed, in a state in which the return channel does not communicate with the outside and an upstream end of the supply channel, to which the liquid supply source is connectable, communicates with the outside, a supply-channel replacement operation in which the liquid in the supply channel is discharged through the liquid ejecting unit is performed.

9. The method according to claim 8, wherein the liquid ejecting apparatus further includes a circulation pump that is disposed in the return channel and that is designed to cause fluid in the circulation channel to flow, wherein, after the return-channel replacement operation has been performed, in a state in which the return channel does not communicate with the outside, a circulation operation in which the circulation pump is driven is performed, and wherein, after the circulation operation has been performed, the supply-channel replacement operation is performed.

* * * * *